US007504814B2

(12) United States Patent
Lee et al.

(10) Patent No.: US 7,504,814 B2
(45) Date of Patent: Mar. 17, 2009

(54) CURRENT GENERATING APPARATUS AND FEEDBACK-CONTROLLED SYSTEM UTILIZING THE CURRENT GENERATING APPARATUS

(75) Inventors: Chien-Lung Lee, Hsinchu (TW); Yi-Wen Huang, Tainan County (TW)

(73) Assignee: Analog Integrations Corporation, Science Park, Hsin-Chu (TW)

( * ) Notice: Subject to any disclaimer, the term of this patent is extended or adjusted under 35 U.S.C. 154(b) by 252 days.

(21) Appl. No.: 11/567,228

(22) Filed: Dec. 6, 2006

(65) Prior Publication Data

US 2008/0067991 A1 Mar. 20, 2008

Related U.S. Application Data

(60) Provisional application No. 60/826,076, filed on Sep. 18, 2006.

(51) Int. Cl.
*G05F 3/16* (2006.01)

(52) U.S. Cl. ..... 323/316; 323/281

(58) Field of Classification Search ..... 323/281, 323/315, 316

See application file for complete search history.

(56) References Cited

U.S. PATENT DOCUMENTS 4,767,979 A * 8/1988 Tanigawa ..... 323/316
5,028,822 A * 7/1991 Hughes ..... 327/581
5,034,626 A * 7/1991 Pirez et al. ..... 327/542
5,043,652 A * 8/1991 Rybicki et al. ..... 323/316
5,625,281 A * 4/1997 Lambert ..... 323/315
6,242,897 B1 * 6/2001 Savage et al. ..... 323/313
7,161,340 B2 * 1/2007 Chiu ..... 323/316
7,253,599 B2 * 8/2007 Chen et al. ..... 323/316
7,301,321 B1 * 11/2007 Uang et al. ..... 323/313
7,375,504 B2 * 5/2008 Mheen et al. ..... 323/315
7,382,180 B2 * 6/2008 Chen ..... 327/543
7,436,248 B2 * 10/2008 Furuichi ..... 327/543
2002/0093324 A1 * 7/2002 Juang ..... 323/316

* cited by examiner

*Primary Examiner*—Jeffrey L Sterrett
(74) *Attorney, Agent, or Firm*—Winston Hsu

(57) ABSTRACT

The present invention discloses a current generating apparatus for generating an output current. The current generating apparatus includes: a first current mirror; a first bias current generator for providing a first bias current, and the first bias current generator includes: a first current source for providing the first current; and a capacitive device for conducting a reference current; a second current mirror for generating a second mirror current; a second bias current generator for generating a second current; a third current source for providing a third current, wherein the second mirror current is equal to the third current; a feedback circuit; and a fourth current source for providing a fourth current, wherein the output current is outputted at an output node of the first current mirror.

13 Claims, 11 Drawing Sheets

CURRENT GENERATING APPARATUS AND FEEDBACK-CONTROLLED SYSTEM UTILIZING THE CURRENT GENERATING APPARATUS

CROSS REFERENCE TO RELATED APPLICATIONS

This application claims the benefit of U.S. Provisional Application No. 60/826,076, which was filed on Sep. 18, 2006 and is included herein by reference.

BACKGROUND OF THE INVENTION

1. Field of the Invention

The present invention relates to providing frequency compensation, and more particularly, to a feedback-controlled system (e.g., an LDO voltage regulator) using a current generating apparatus capable of minimizing the DC offset of an output current used for frequency compensation.

2. Description of the Prior Art

Please refer to FIG. 1. FIG. 1 is a diagram illustrating a first conventional LDO (low dropout) voltage regulator 10. The LDO voltage regulator 10 comprises a pass transistor MP, a feedback voltage divider 11, and an error amplifier 12. The connections between the pass transistor MP, the feedback voltage divider 11, and the error amplifier 12 are shown in FIG. 1. The input terminal $N_{in}$ of the LDO voltage regulator 10 is coupled to a supply voltage VDD. The output terminal $N_{out}$ of the LDO voltage regulator 10 is coupled to a loading stage, which is equivalent to a resistor $R_L$ connected with a capacitor $C_L$ in parallel. Please note that the terminal $N_g$ has a parasitic resistor $R_{PAR}$ and a parasitic capacitor $C_{PAR}$, where the capacitor $C_L$ has an equivalent series resistance of $R_{ESR}$ connected to the capacitor $C_L$. Accordingly, it is well-known that there are two low-frequency poles that need to be taken into account when determining the closed-loop transfer function of the frequency response of the LDO voltage regulator 10. In order to guarantee the phase margin of the LDO voltage regulator 10 will be greater than 45 degrees, a zero is introduced to compensate the phase contribution of the two low-frequency poles. Normally, the series combination of the capacitor $C_L$ and the equivalent series resistance $R_{ESR}$ generates a zero $\omega_{ESR}$ that provides the LDO voltage regulator 10 with proper phase margin. However, in some conditions, the equivalent series resistance $R_{ESR}$ fails to provide proper phase margin for the LDO voltage regulator 10. Please refer to FIG. 2. FIG. 2 is a frequency response diagram of the LDO voltage regulator 10 with various load currents $I_L$ at fixed $\omega_{ESR}$. For brevity, three Bode plots 21, 22, and 23 are shown in FIG. 2, which correspond, respectively, to light load current, proper load current, and heavy load current of the LDO voltage regulator 10. Furthermore, there are three poles and one zero for each of the Bode plots 21, 22, and 23, in which the first pole $\omega_{p1}$ is mainly concentrated at the output terminal $N_{out}$, the second pole $\omega_{p2}$ is mainly concentrated at the terminal $N_g$ of the transistor MP, and the zero is $\omega_{ESR}$. When the load current $I_L$ varies from the heavy load status to the light load status, the first pole $\omega_{p1}$ decreases roughly and the second pole $\omega_{p2}$ decreases as well, as shown in the Bode plots 21, 22, and 23 of FIG. 2. Furthermore, three of the Bode plots 21, 22, and 23 have poor phase margin in this case. There are at least three drawbacks by utilizing the zero $\omega_{ESR}$ to compensate the pole of the LDO voltage regulator 10. Firstly, the high-frequency bypass capacitor $C_{gdpass}$ placed in parallel with the capacitor $C_L$ provides another pole with the zero $\omega_{ESR}$ of the capacitor $C_L$, in which the new pole will further decrease the phase margin of the LDO voltage regulator 10. Secondly, the equivalent series resistance of $R_{ESR}$ of the capacitor $C_L$ is not properly specified in many cases and varies with temperature. As a result, the zero $\omega_{ESR}$ cannot be predicted easily. Thirdly, owing to some advantages of ceramic capacitors, such as low $R_{ESR}$, less expense, and compact printed circuit boards, using the ceramic capacitor is becoming more popular. However, it is hard to generate a proper zero $\omega_{ESR}$ with the low $R_{ESR}$.

Besides utilizing the zero $\omega_{ESR}$ to compensate the pole of the LDO voltage regulator 10, there are various other frequency compensation means taught in the prior art. Please refer to FIG. 3. FIG. 3 is a diagram illustrating a second conventional LDO voltage regulator 30 having a prior art frequency compensation implemented therein. The LDO voltage regulator 30 shown in FIG. 3 is equivalent to applying the prior art frequency compensation to the LDO voltage regulator 10. The frequency compensation method of FIG. 3 is to provide a feedback path for the output voltage $V_{out}$ through an additional capacitor CF, and the connection is shown in FIG. 3. The capacitor CF provides a high-frequency bypass path for the loop gain of the LDO voltage regulator 10. Then a pole-zero pair ($\omega_p$, $\omega_z$) is generated, which is represented by the following equation (1) and equation (2), $$\omega_z=1/(R_{F1}*CF), \tag{1}$$

$$\omega_p=(1+(R_{F1}/R_{F2}))/(R_{F1}*CF) \tag{2}$$

According to this prior art circuit configuration, due to the fact that the resistance magnitudes of feedback resistors $R_{F1}$ and $R_{F2}$ have the same order, the pole $\omega_p$ and the zero $\omega_z$ are not far from each other as shown in FIG. 4. FIG. 4 is a diagram illustrating the frequency response of capacitive feedback frequency compensation of FIG. 3. The curve 41 represents the transferring characteristic of the frequency compensation of FIG. 3, and the curve 42 represents the phase variation of the frequency compensation of FIG. 3. Accordingly, the zero $\omega_z$ contributes less phase margin for the frequency compensation of FIG. 3.

According to the reference of Chaitanya K. Chaya, and Jose Silva-Martinez, "A Frequency Compensation Scheme for LDO Voltage Regulators", *IEEE TRANSACTIONS ON CIRCUITS AND SYSTEMS-I. REGULAR PAPERS*, VOL. 51, NO. 6, Jun. 2004, an improved prior art frequency compensation developed from the frequency compensation of FIG. 3 is proposed. Please refer to FIG. 5. FIG. 5 is a diagram illustrating a third conventional LDO voltage regulator 50 having another prior art frequency compensation implemented therein. The LDO voltage regulator 50 shown in FIG. 5 is equivalent to applying the improved prior art frequency compensation to the LDO voltage regulator 10. The frequency compensation of FIG. 5 is implemented using a frequency-dependent voltage-controlled current source (VCCS) 52 connected at the feedback terminal $N_{FB}$ of the LDO voltage regulator 50. The frequency-dependent VCCS 52 is capable of eliminating the pole $\omega_p$ of FIG. 3 and generate a new zero $\omega_{z0}$. The new zero $\omega_{z0}$ is determined by the following equation:

$$\omega_{z0}=1/(N*R_{F1}*CF). \tag{3}$$

Therefore, the location of the new zero $\omega_{z0}$ can be easily adjusted by modifying the current mirror ratio N set to the current mirrors 54*a*, 54*b* or modifying the capacitance of the ground capacitor $C_1$ of the FIG. 6. FIG. 6 is a diagram illustrating the frequency-dependent voltage-controlled current source 52 shown in FIG. 5. However, the mismatch of the current mirror 54*a* and the current mirror 54*b*, both having the same current mirror ratio N, induces a DC current $\Delta I_B$ flowing into the feedback resistors $R_{F1}$, $R_{F2}$, and equivalently forms a mismatch resistor $R_{mismatch}$ parallel with the feedback resistors $R_{F1}$, $R_{F2}$ as shown in FIG. 6. Hence, the output voltage $V_{out}$ varies due to the mismatch resistor $R_{mismatch}$ from the imbalanced current mirrors 54*a*, 54*b*. Furthermore, the mismatch of current mirrors 54*a*, 54*b* contributes considerable yield loss for chip mass production. In addition, the mismatch current $\Delta I_B$ is in proportion to the current mirror ratio N of current mirrors 54*a*, 54*b*. Furthermore, as the output voltage $V_{out}$ changes, the mismatch current $\Delta I_B$ changes accordingly. In order to decrease the effect of the mismatch current $\Delta I_B$, the current mirror ratio N of the current mirrors 54*a*, 54*b* should preferably be lower, and the capacitance of the grounded capacitor $C_1$ should preferably be larger. However, the larger the capacitance, the higher the production cost and chip area becomes.

SUMMARY OF THE INVENTION

Therefore, one of the objectives of the present invention is to provide a feedback-controlled system (e.g. an LDO voltage regulator) using a current generating apparatus capable of minimizing the DC offset of an output current used for frequency compensation.

According to an embodiment of the present invention, a current generating apparatus is disclosed for generating an output current. The current generating apparatus comprises: a first current mirror, a first bias current generator, a second current mirror, a second bias current generator, a third current source, a feedback circuit, and a fourth current source. The first current mirror generates a first mirror current according to a first bias current and a current mirror ratio. The first bias current generator is coupled to the first current mirror for providing the first bias current according to a first current and a reference current, and the first bias current generator comprises: a first current source biased by a first bias voltage for providing the first current; and a capacitive device coupled to the first current source in parallel for conducting the reference current. The second current mirror generates a second mirror current according to a second bias current and the current mirror ratio. The second bias current generator is coupled to the second current mirror, and the second bias current generator has a second current source biased by the first bias voltage for generating a second current serving as the second bias current. The third current source is coupled to an output node of the second current mirror, and is biased by a second bias voltage to provide a third current, wherein the second mirror current is equal to the third current. The feedback circuit is coupled to the output node of the second current mirror and the third current source for tuning the second bias voltage according to a voltage level at the output node of the second current mirror and a target voltage level. The fourth current source is coupled to an output node of the first current mirror, and is biased by the second bias voltage to provide a fourth current, wherein the output current is outputted at the output node of the first current mirror.

According to an embodiment of the present invention, a feedback-controlled system is disclosed. The feedback-controlled system comprises: a plurality of operational stages cascaded in a closed loop; and a current generating apparatus. The current generating apparatus generates an output current to an output of a first operational stage in the operational stages. The current generating apparatus comprises: a first current mirror, a first bias current generator, a second current mirror, a second bias current generator, a third current source, a feedback circuit, and a fourth current source. The first current mirror generates a first mirror current according to a first bias current and a current mirror ratio. The first bias current generator is coupled to the first current mirror for receiving an output of a second operational stage in the operational stages and providing the first bias current according to a first current and a reference current. The first bias current generator comprises: a first current source for providing the first current according to a first bias voltage and the output of the second operational stage; and a capacitive device coupled to the first current source in parallel for conducting the reference current. The second current mirror generates a second mirror current according to a second bias current and the current mirror ratio. The second bias current generator is coupled to the second current mirror, and the second bias current generator has a second current source for generating a second current serving as the second bias current according to the first bias voltage and the output of the second operational stage. The third current source is coupled to an output node of the second current mirror, and is biased by a second bias voltage to provide a third current, wherein the second mirror current is equal to the third mirror current. The feedback circuit is coupled to the output node of the second current mirror and the third current source for tuning the second bias voltage according to a voltage level at the output node of the second current mirror and a target voltage level. The fourth current source is coupled to an output node of the first current mirror, and is biased by the second bias voltage to provide a fourth current, wherein the output current is outputted from the output node of the first current mirror.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
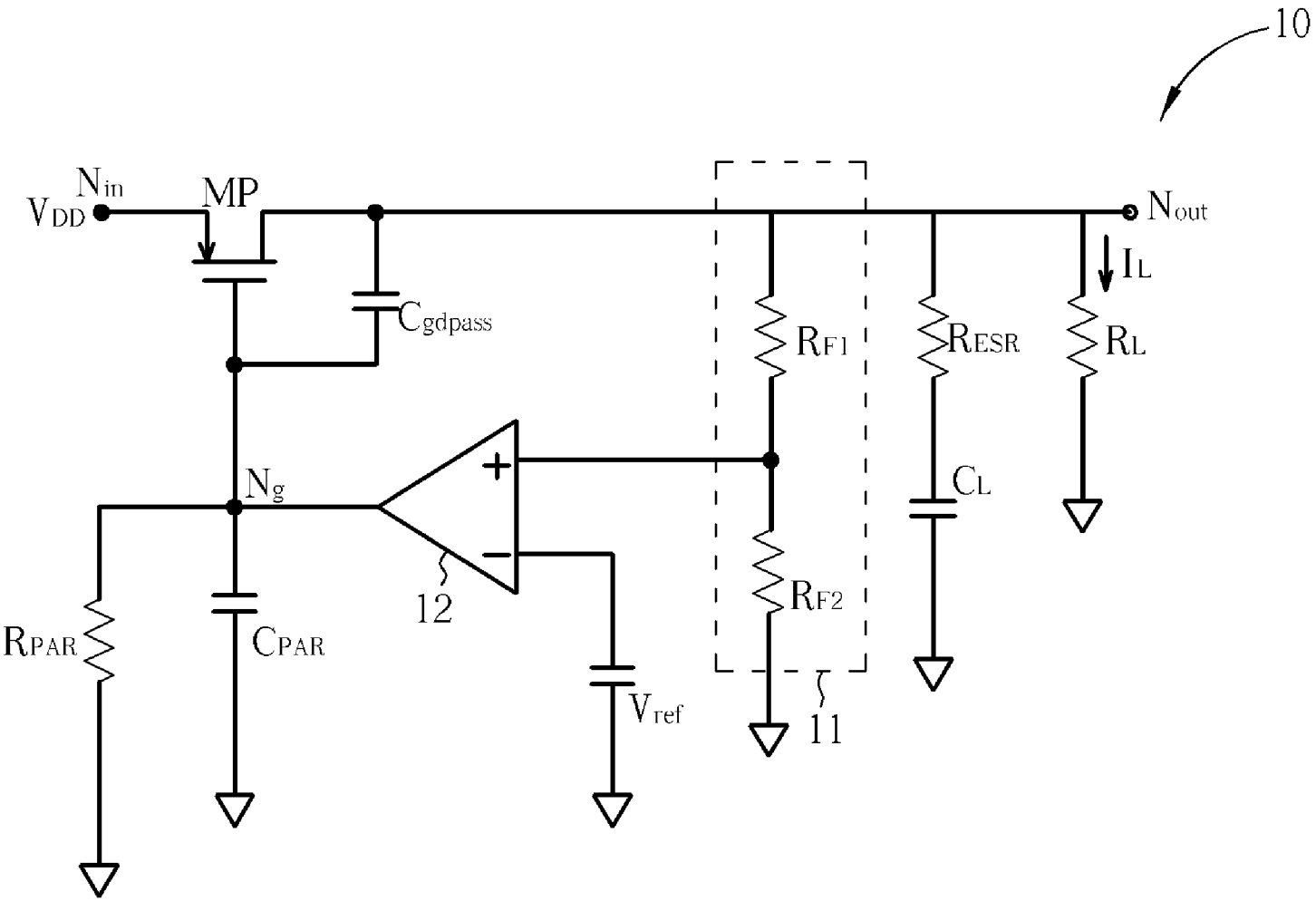
Fig. 1 Prior Art
FIG. 1 is a diagram illustrating a prior art LDO voltage regulator.
Figure 2:
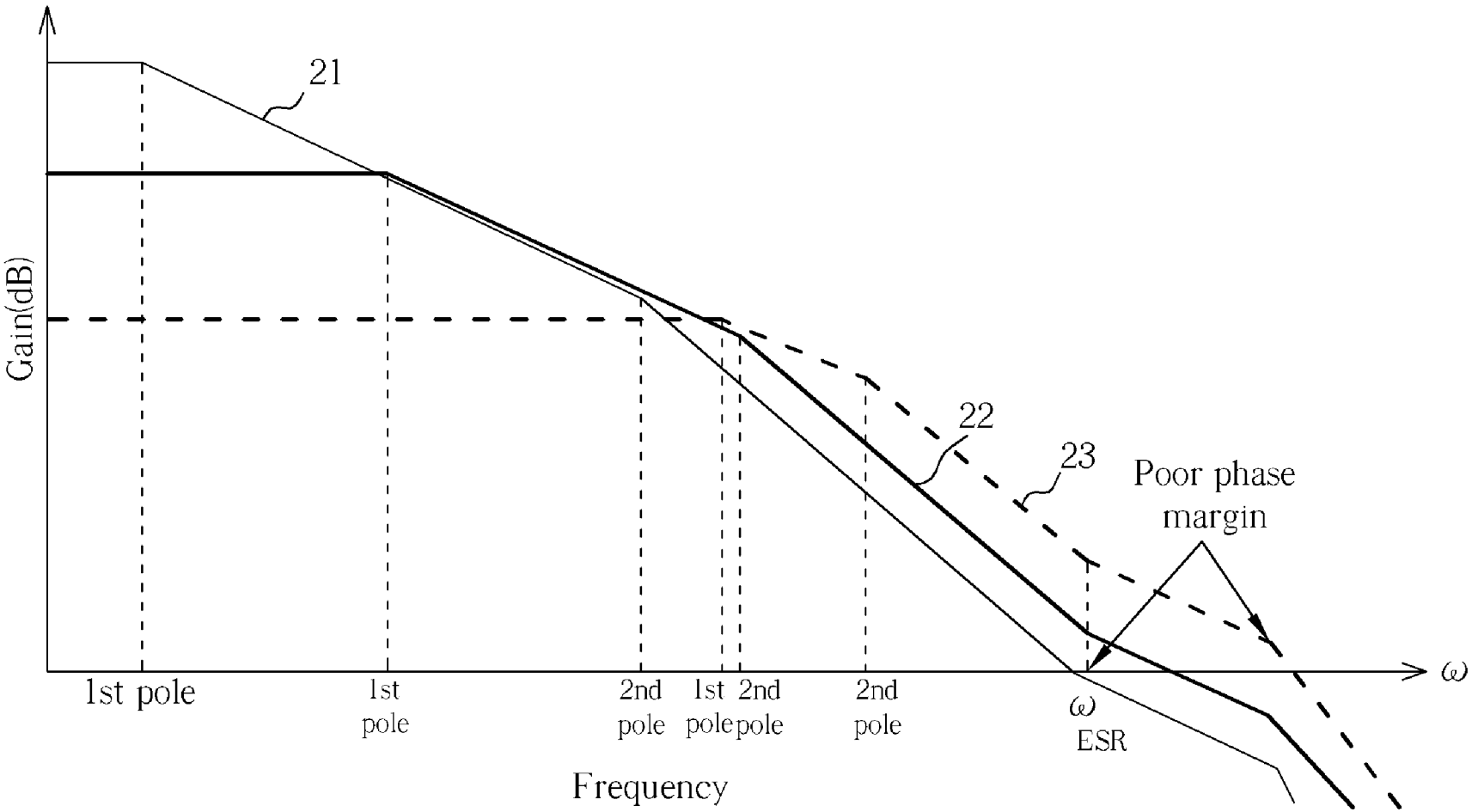
Fig. 2 Prior Art
FIG. 2 is a frequency response diagram of the LDO voltage regulator.
Figure 3:
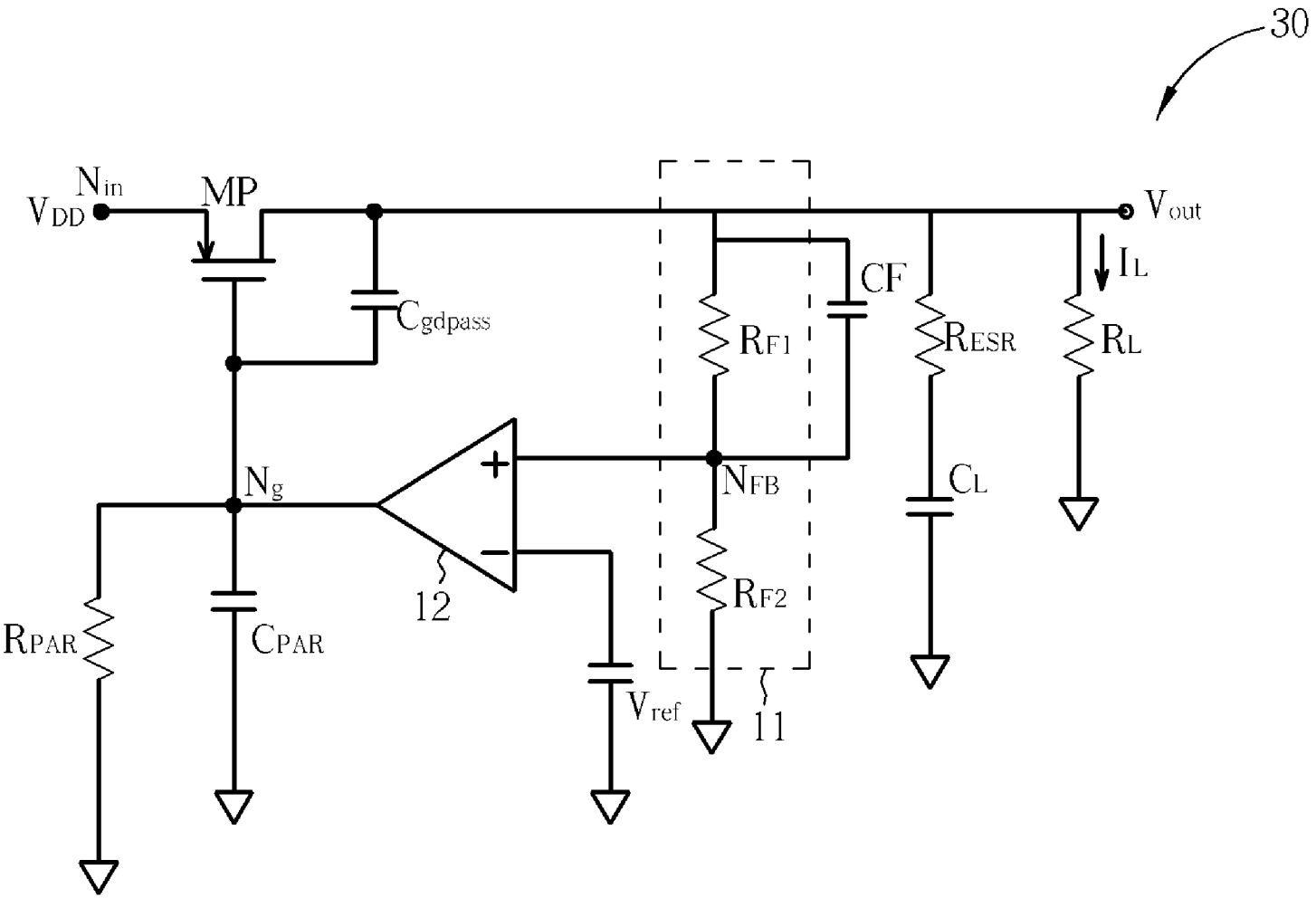
Fig. 3 Prior Art
FIG. 3 is a diagram illustrating a frequency compensation according to the prior art utilized in the LDO voltage regulator of FIG. 1.
Figure 4:
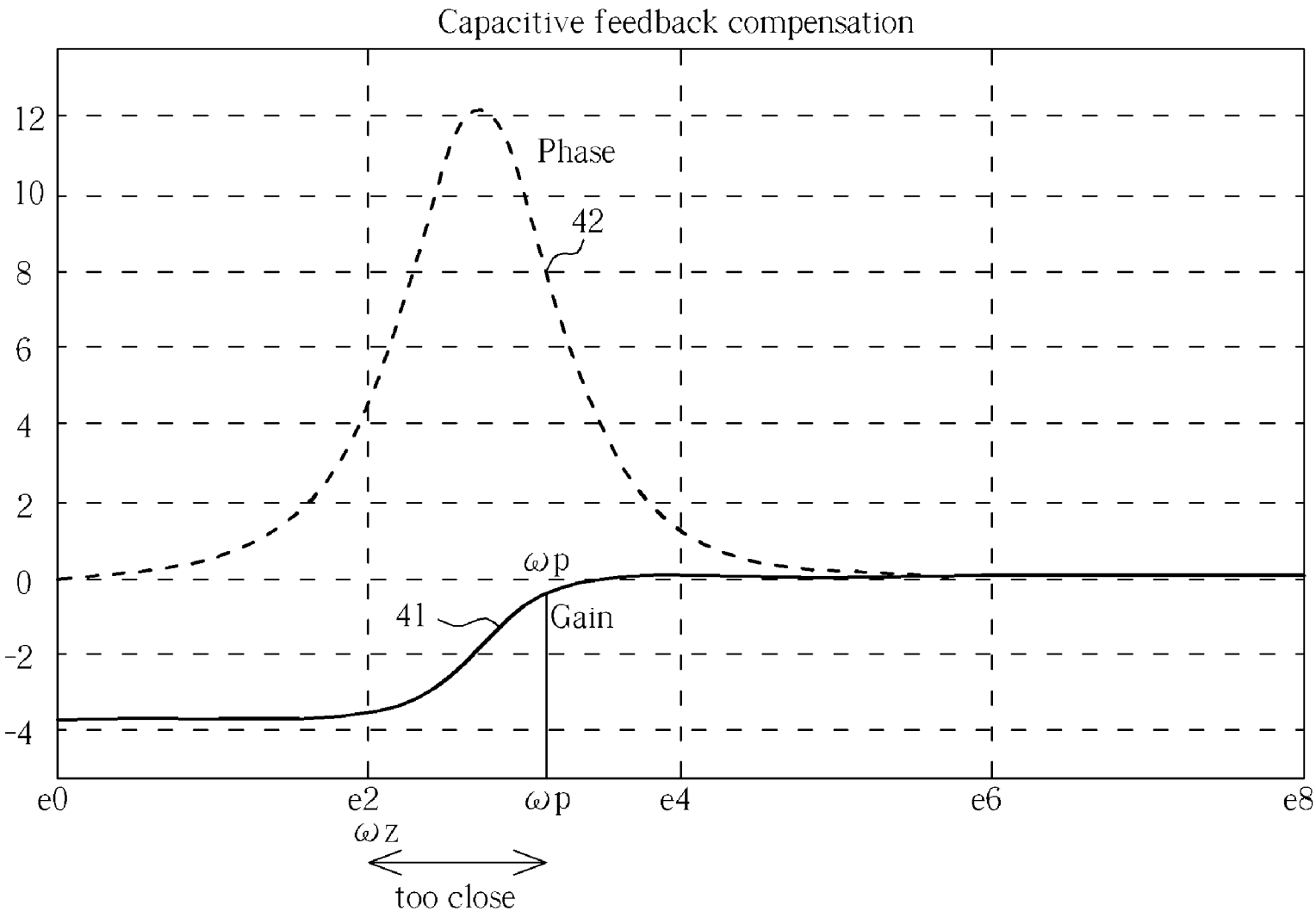
Fig. 4 Prior Art
FIG. 4 is a diagram illustrating the frequency response of the capacitive feedback frequency compensation of FIG. 3.
Figure 5:
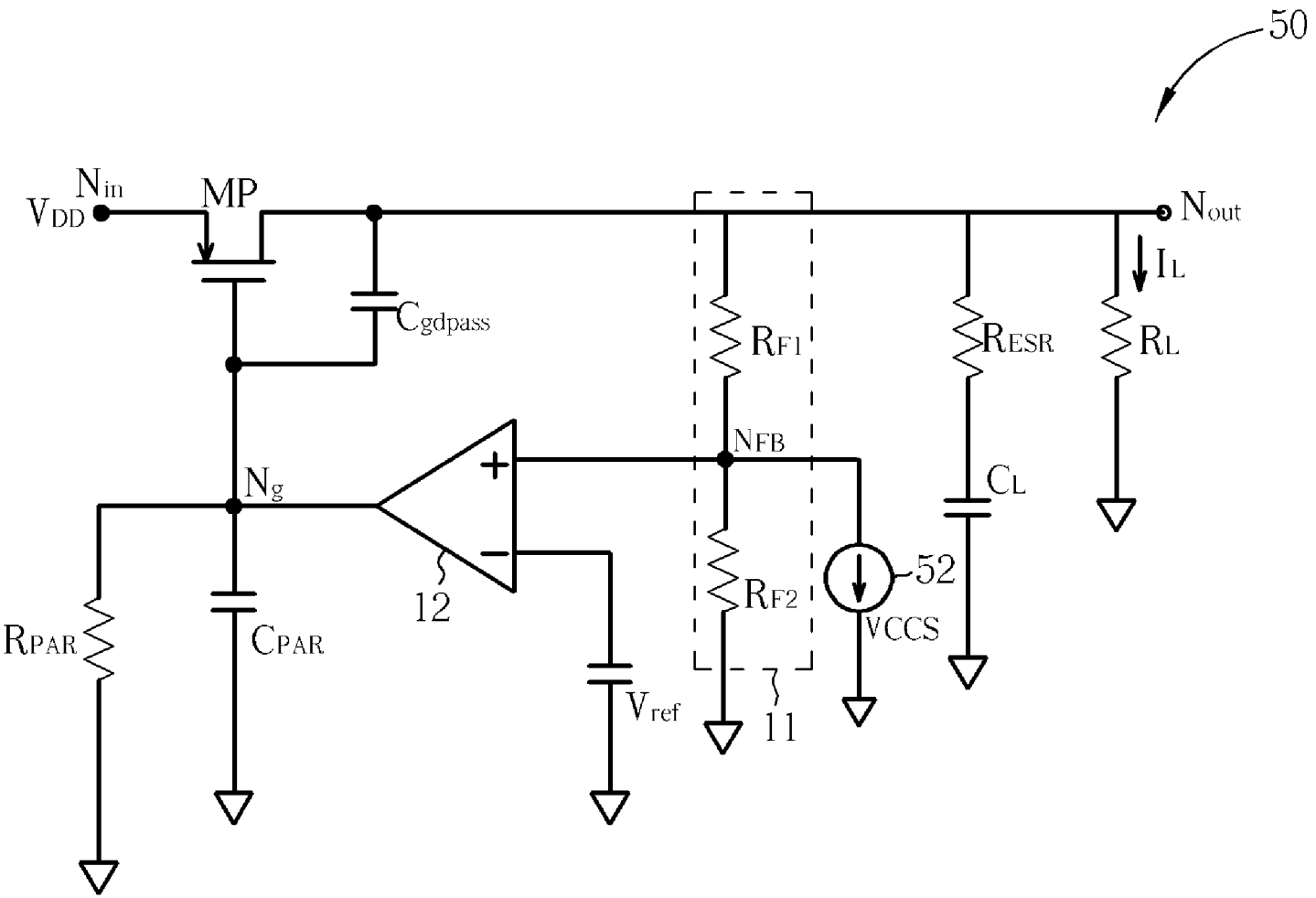
Fig. 5 Prior Art
FIG. 5 is a diagram illustrating the prior art frequency compensation that improves on the frequency compensation of FIG. 3.
Figure 6:
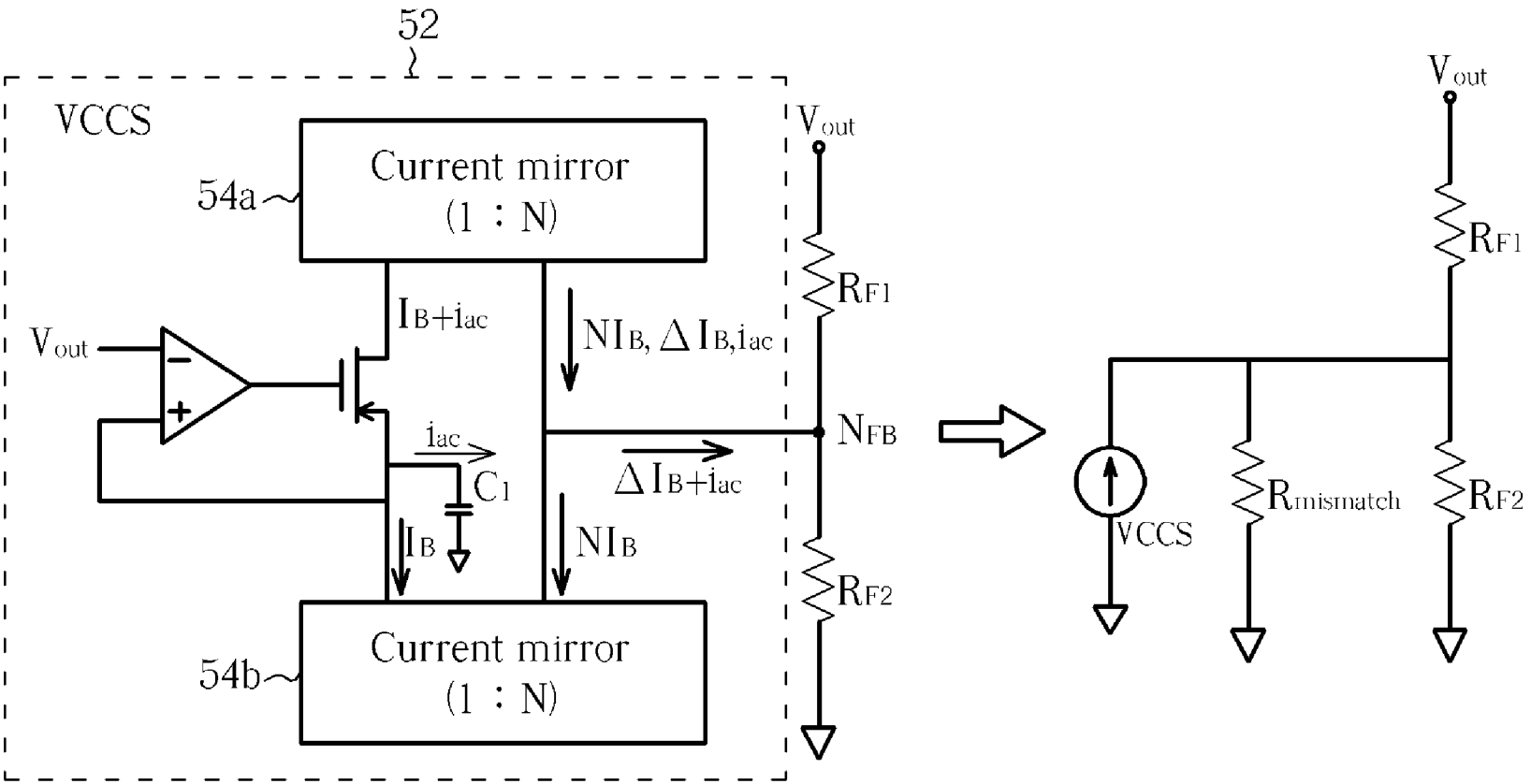
Fig. 6 Prior Art
FIG. 6 is a diagram illustrating the prior art frequency-dependent voltage-controlled current source of FIG. 5.
Figure 7:
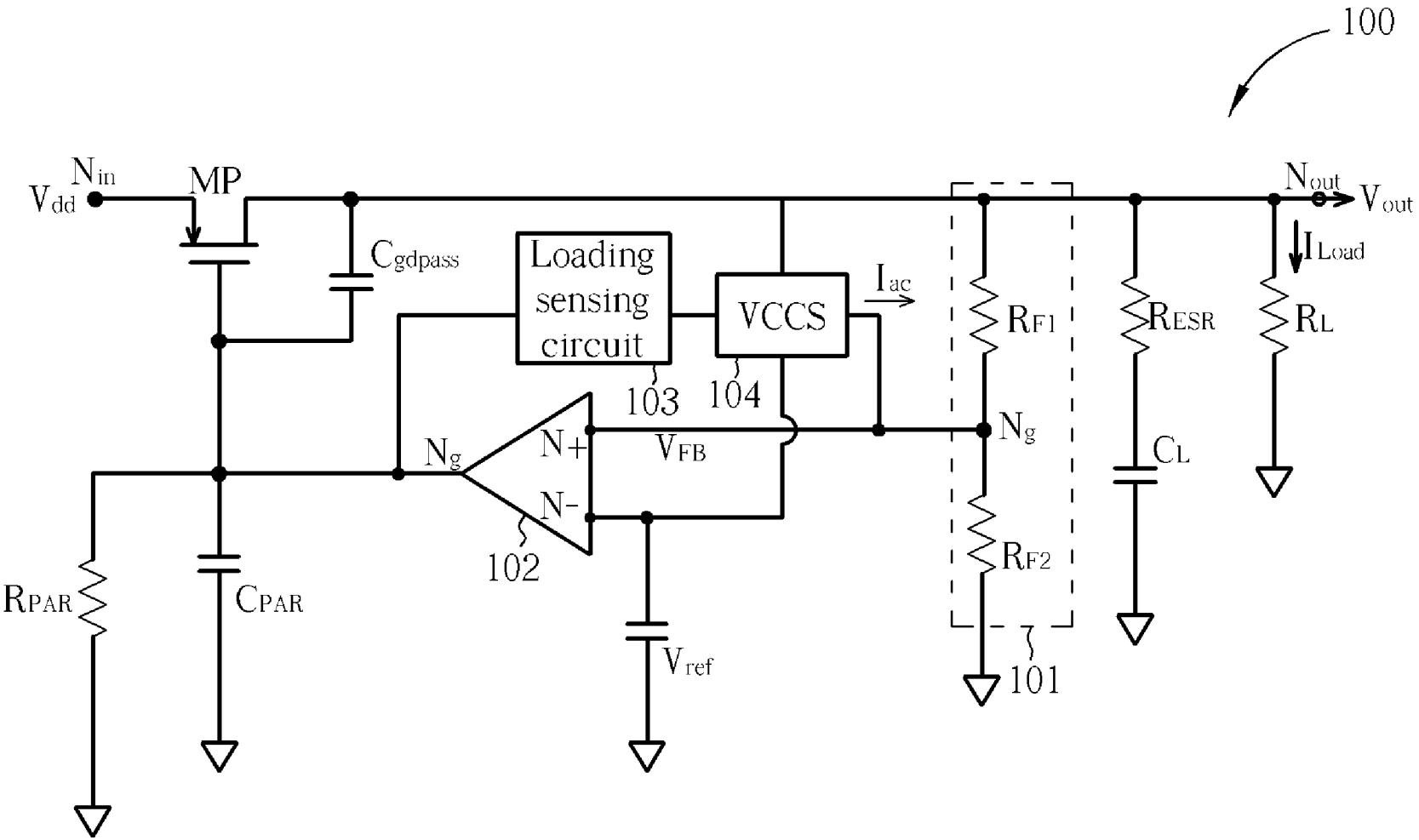
FIG. 7 is a diagram illustrating a voltage regulator according to an embodiment of the present invention.

Please refer to FIG. 7. FIG. 7 is a diagram illustrating a voltage regulator 100 according to an embodiment of the present invention. The voltage regulator 100 is a low dropout (LDO) voltage regulator that can track the loading current of the voltage regulator 100 to adjust the zero of the voltage regulator 100. The voltage regulator 100 comprises a pass transistor $M_p$, a voltage divider 101, an error amplifier 102, a loading sensing circuit 103, and a voltage-controlled current source (VCCS) 104. The pass transistor $M_p$, which is a PMOS transistor, has a source terminal $N_{in}$ coupled to a supply voltage $V_{dd}$ and a drain terminal $N_{out}$ for outputting an output voltage $V_{out}$. The voltage divider 101 comprises two feedback resistors $R_{F1}$ and $R_{F2}$, connected in series, where the feedback resistor $R_{F1}$ has a terminal coupled to the drain terminal $N_{out}$ and another terminal coupled to the feedback resistor $R_{F2}$. The voltage divider 101 is utilized for providing a feedback voltage level $V_{FB}$ according to the output voltage $V_{out}$ passed by the pass transistor $M_p$. The error amplifier 102 has a first input node (i.e. a non-inverting node) N+ coupled to the voltage divider 101 for receiving the feedback voltage level $V_{FB}$, a second input node (i.e. an inverting node) N− coupled to the target voltage level $V_{ref}$, and an output node $N_g$ coupled to a gate terminal of the pass transistor $M_p$. The voltage-controlled current source 104 is coupled to the voltage divider 101 (i.e. the first input node N+) for generating an output current $I_{ac}$ at the first input node N+ of the error amplifier 102, in which the output current $I_{ac}$ is a voltage-controlled AC current. The loading sensing circuit 103 is coupled to the voltage-controlled current source 104 and the gate terminal $N_g$ (i.e. the output node) of the pass transistor $M_P$, for sensing the loading current $I_{Load}$ variation of the voltage regulator 100 to adjust the output current $I_{ac}$ of the voltage-controlled current source 104. Furthermore, the drain terminal $N_{out}$ is coupled to a loading circuit, which is equivalent to a loading resistor $R_L$ connected with a loading capacitor $C_L$ in parallel. Please note that the loading capacitor $C_L$ has an equivalent series resistance of $R_{ESR}$ connected with the loading capacitor $C_L$. The output node $N_g$ is connected to a parasitic resistor $R_{PAR}$ and a parasitic capacitor $C_{PAR}$ in parallel.

Figure 8:
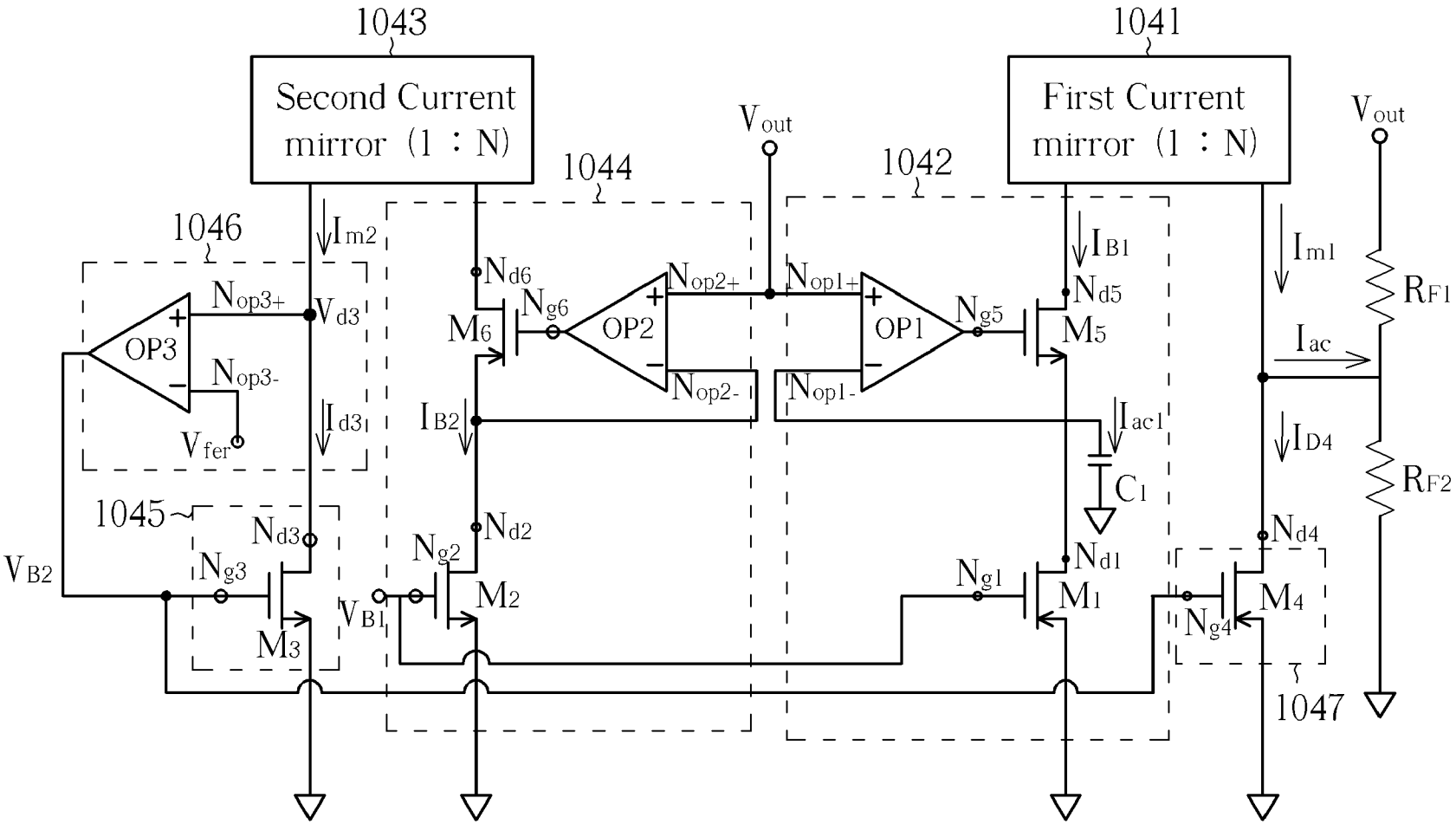
FIG. 8 is a diagram illustrating the voltage-controlled current source in the voltage regulator of FIG. 7.

Please refer to FIG. 8. FIG. 8 is a diagram illustrating the voltage-controlled current source 104 in the voltage regulator 100 of FIG. 7. The voltage-controlled current source 104 comprises a first current mirror 1041, a first bias current generator 1042, a second current mirror 1043, a second bias current generator 1044, a third current source 1045, a feedback circuit 1046, and a fourth current source 1047. The first current mirror 1041 generates a first mirror current $I_{M1}$ according to a first bias current $I_{B1}$ and a current mirror ratio N. The first bias current generator 1042 is coupled to the first current mirror 1041 for providing the first bias current $I_{B1}$ according to a first current $I_B$ and a reference current $I_{ac1}$. In this embodiment, the first bias current $I_{B1}$ is a sum of the first current $I_B$ and the reference current $I_{ac1}$. The first bias current generator 1042 comprises a first current source, which is implemented using a transistor $M_1$, having a gate terminal $N_{g1}$ biased by a first bias voltage $V_{B1}$ for generating the first bias current $I_{B1}$; and a capacitive device $C_1$ coupled to the drain terminal $N_{d1}$ of the transistor $M_1$ in parallel for conducting the reference current $I_{ac1}$. Therefore, the reference current $I_{ac1}$ is equal to $s*C_1*V_{out}$, where the symbol s represents jω. The second current mirror 1043 generates a second mirror current $I_{M2}$ according to a second bias current $I_{B2}$ and the current mirror ratio N. The second bias current generator 1044 is coupled to the second current mirror 1043 and has a second current source, which is implemented using a transistor $M_2$ having a gate terminal $N_{g2}$ biased by the first bias voltage $V_{B1}$ for generating a second current $I_{B2}$ serving as the second bias current. In this embodiment, the transistors $M_1$ and $M_2$ have the same configuration and are biased by the same bias voltage $V_{B1}$, thus the first current $I_{B1}$ is equal to the second current $I_{B2}$. The third current source 1045, which is implemented using a transistor $M_3$, has a drain terminal $N_{d3}$ coupled to an output node of the second current mirror 1043 and the gate terminal $N_{g3}$ biased by a second bias voltage $V_{B2}$ for providing a third current $I_{D3}$, wherein the second mirror current 1043 is equal to the third current $I_{D3}$. The feedback circuit 1046 is coupled to the output node $N_{d3}$ of the second current mirror 1043 and the third current source 1045, for tuning the second bias voltage $V_{B2}$ according to the target voltage level $V_{ref}$ of the voltage regulator 100 and the voltage $V_{d3}$ at the output node $N_{d3}$ of the second current mirror 1043. The fourth current source 1047, which is implemented using a transistor $M_4$ has a drain terminal coupled to the output node $N_{d4}$ of the first current mirror 1041 and the gate terminal $N_{g4}$ biased by the second bias voltage $V_{B2}$ for providing a fourth current $I_{D4}$. Furthermore, the output current $I_{ac}$ is outputted at the output node of the first current mirror 1041, which is the first input node N+ of the error amplifier 102.

The first bias current generator 1042 further comprises a transistor $M_5$ having a drain terminal $N_{d5}$ coupled to the first current mirror 1041, a source terminal coupled to the drain terminal $N_{d1}$ of the transistor $M_1$ and a gate terminal $N_{g5}$; and a first error amplifier OP1 having a first input node $N_{OP1+}$ coupled to the output voltage $V_{out}$ of the voltage regulator 100, a second input node $N_{OP1-}$ coupled to the source terminal of the transistor $M_5$, and an output node coupled to the gate terminal $N_{g5}$ of the transistor $M_5$. In addition, the second bias current generator 1044 further comprises a transistor $M_6$ having a drain terminal $N_{d6}$ coupled to the second current mirror 1043, a source terminal coupled to a drain terminal $N_{d2}$ of the transistor $M_2$, and a gate terminal $N_{g6}$; and a second error amplifier OP2 having a first input node $N_{OP2+}$ coupled to the output voltage $V_{out}$ of the voltage regulator 100, a second input node $N_{OP2-}$ coupled to the source terminal of the transistor $M_6$, and an output node coupled to the gate terminal $N_{d6}$ of the transistor $M_6$. Please note that, in this embodiment, the circuit configuration of the transistor $M_5$ and the first error amplifier OP1 is symmetric to that of the transistor $M_6$ and the second error amplifier OP2. As shown in FIG. 8, the feedback circuit 1046 comprises a third error amplifier OP3 having a first input node $N_{OP3+}$ coupled to the drain terminal $N_{d3}$ of the transistor $M_3$, a second input node $N_{OP3-}$ coupled to the target voltage level $V_{ref}$, and an output node coupled to the gate terminal $N_{g3}$ of the transistor $M_3$. The detailed operation of the voltage-controlled current source 104 is illustrated as below.

Please refer to FIG. 7 in conjunction with FIG. 8. Due to the mirroring imperfection between the first bias current $I_{B1}$ and the first mirror current $I_{M1}$ of the first current mirror 1041, the first current mirror 1041 mirrors the first bias current $I_{B1}$ according to the current mirror ratio N to introduce the mismatch current to the first mirror current $I_{M1}$, i.e. $I_{M1}=N*I_{B1}=N*I_B+N*I_{ac1}+\Delta I_{B1}$, where $\Delta I_{B1}$ is the mismatch current induced by the first current mirror 1041. Similarly, due to the mirroring imperfection between the second bias current $I_{B2}$ and the second mirror current $I_{M2}$ of the second current mirror 1043, the second current mirror 1043 mirrors the second bias current $I_{B2}$ according to the current mirror ratio N to introduce the mismatch current to the second mirror current $I_{M2}$, i.e. $I_{M2}=N*I_{B2}+\Delta I_{B2}$, where $\Delta I_{B2}$ is the mismatch current induced by the second current mirror 1043. Please note that, since the second current mirror 1043 is a replica of the first current mirror 1041 in this embodiment (i.e. both have the same current mirror ratio N), the mismatch current $\Delta I_{B1}$ is substantially equal to the mismatch current $\Delta I_{B2}$, i.e. $\Delta I_{B1}=\Delta I_{B2}$. Additionally, the first error amplifier OP1 is operative to lock the voltage level at the drain terminal $N_{d2}$ to the output voltage $V_{out}$, and the first error amplifier OP1 is also operative to lock the voltage level at the drain terminal $N_{d2}$ to the output voltage $V_{out}$. As shown in FIG. 8, the transistors $M_1$ and $M_2$ are both biased by the same bias voltage $V_{B1}$. As a result, the first current $I_{B1}$ is substantially the same as the second current $I_{B2}$ because of the same bias condition applied to the transistors $M_1$ and $M_2$.

On the other hand, the feedback circuit 1046, acting as a common mode feedback circuit of the transistors $M_3$, is utilized to make the voltage $V_{d3}$ approach to the target voltage level $V_{ref}$ of the voltage regulator 100 by controlling the transistor $M_3$. Furthermore, the feedback voltage level $V_{FB}$ at the output node $N_{d4}$ also approaches to the target voltage level $V_{ref}$ of the voltage regulator 100 because of the error amplifier 102. Therefore, both of the transistors $M_3$ and $M_4$ are operated under substantially identical bias condition. In this way, as the feedback voltage $V_{FB}$ and the drain voltage $V_{d3}$ are both equal to the target voltage $V_{ref}$ with the help of the error amplifier 102 and the third error amplifier OP3, the third current $I_{D3}$ of the transistor $M_3$ is sure to coincide with the fourth current $I_{D4}$ of the transistor $M_4$, i.e. $I_{D3}=I_{D4}=N*I_{B2}+\Delta I_{B2}$. Accordingly, referring to Kirchhoff's Laws, the output current $I_{ac}$ can be obtained by subtracting the fourth current $I_{D4}$ from the first mirror current $I_{M1}$ (i.e. $I_{M1}=N*I_B+N*I_{ac1}+\Delta I_{B1}$), which is the AC current of $N*I_{ac1}$ (i.e. $N*s*C_1*V_{out}$). Compared with the prior art, the voltage-controlled current source (i.e. the output current $I_{ac}$) of $N*s*C_1*V_{out}$ with no mismatch current $\Delta I_B$ can be obtained, ideally. In a real application, the induced mismatch current $\Delta I_B$ is very small, and can be neglected.

Figure 9:
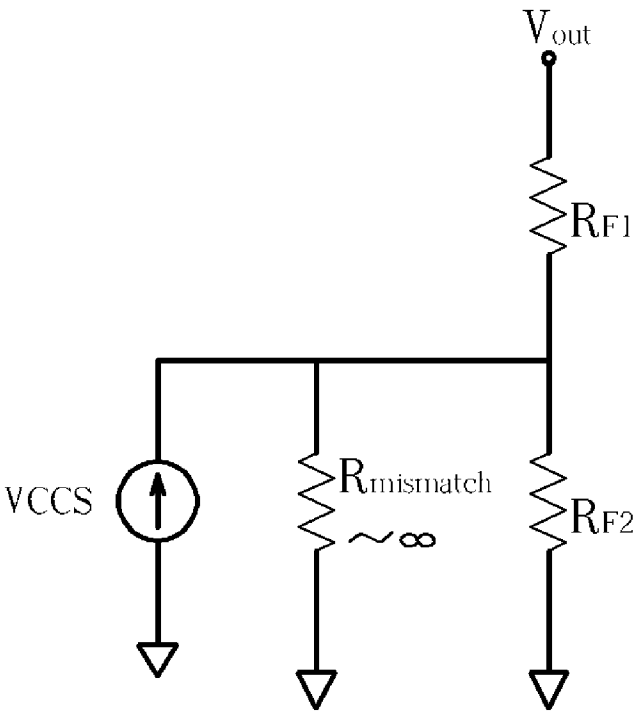
FIG. 9 is a diagram illustrating an equivalent schematic of the voltage-controlled current source in the voltage regulator of FIG. 7.

Please refer to FIG. 9. FIG. 9 is a diagram illustrating an equivalent schematic of the voltage-controlled current source 104 in the voltage regulator 100 of FIG. 7. Therefore, as one can see, the voltage-controlled current source 104 provides an ideal frequency-dependent voltage-controlled current source, where $R_{mismatch}$ approaches to $\infty$.

Figure 10:
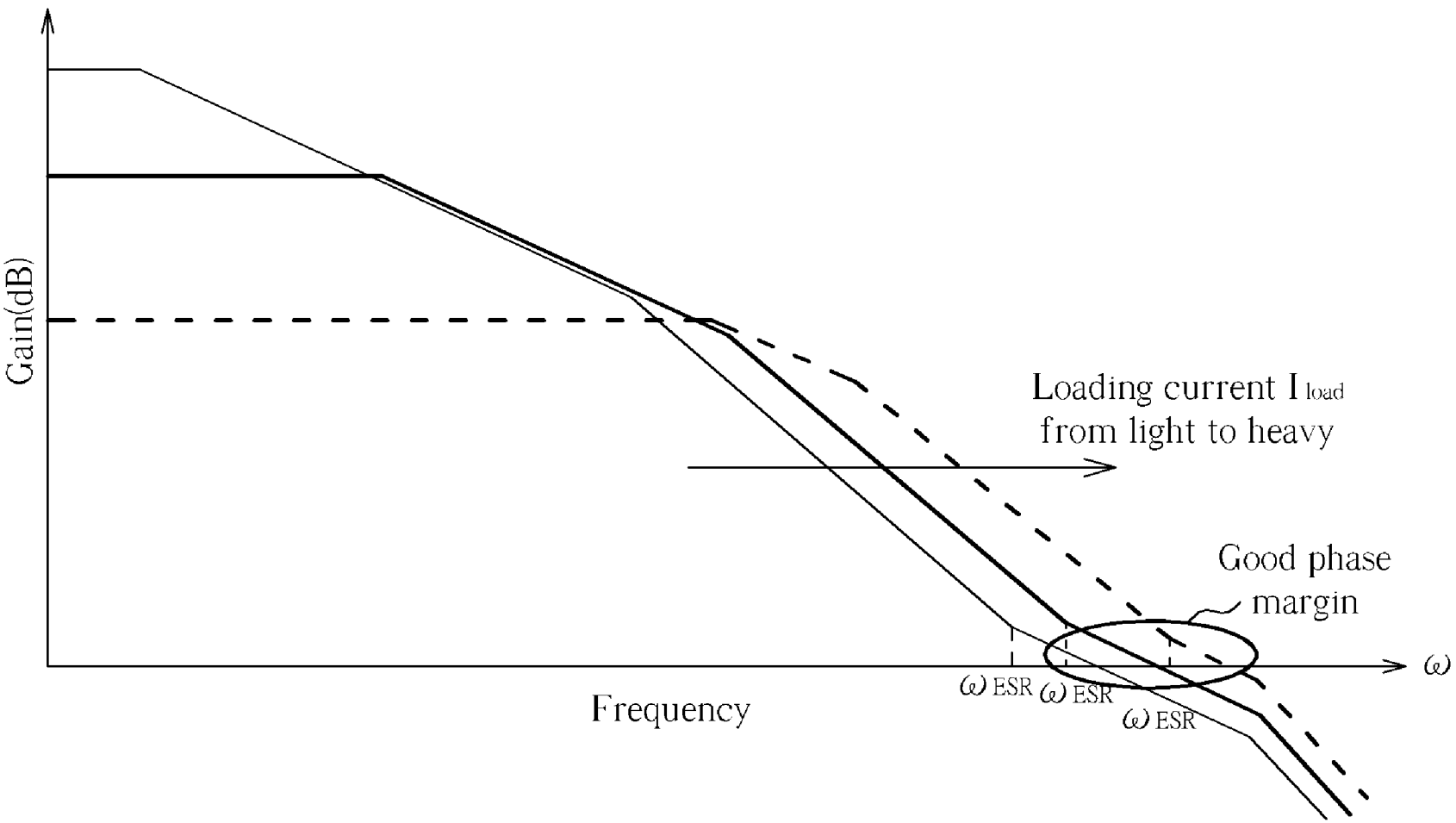
FIG. 10 is a diagram illustrating the frequency response of the voltage regulator of FIG. 7.

Please refer to FIG. 7 again. In order to obtain a good phase margin for all loading current $I_{Load}$ of the voltage regulator 100 of FIG. 7, a location of zero $\omega_{ESR}$ of the voltage regulator 100 should be adjustable with the loading current $I_{Load}$. In other words, the zero $\omega_{ESR}$ is higher for heavy loading current $I_{Load}$ (i.e. small load impedance) and lower for light loading current $I_{Load}$ (i.e. high load impedance) as shown in FIG. 10. FIG. 10 is a diagram illustrating the frequency response of the voltage regulator 100 of FIG. 7. By applying the voltage-controlled current source 104 to compensate the pole of the voltage regulator 100, the zero $\omega_{ESR}$ is directly tuned by modifying the current mirror ratio N of the first current mirror 1041 and the second current mirror 1043 according to the loading current $I_{Load}$ monitored by the loading sensing circuit 103. According to the aforementioned equation (3), the zero $\omega_{ESR}$ of the voltage regulator 100 can be modified as below:

$$\omega_{ESR}=1/(N*R_{F1}*CF). \quad (4)$$

In this embodiment, the loading sensing circuit 103 of the present invention is configured to sense the voltage level at the gate terminal $N_g$ (i.e. the output node) of the pass transistor $M_P$ to detect the loading current variation. Then the loading sensing circuit 103 changes the current mirror ratio N of the first current mirror 1041 and the second current mirror 1043 to modify the zero $\omega_{ESR}$ according to the above equation (4). Therefore, as shown in FIG. 10, a good phase margin can be obtained as compared with the prior art. Please note that, the loading sensing circuit 103 of the present invention is not limited to sensing the voltage level at the gate terminal $N_g$ of the pass transistor $M_P$ to detect the loading current variation. That is, any other terminal voltage of the voltage regulator 100 that can be referred to for tracking the loading current $I_{Load}$ also can be adopted. These alternative designs all fall in the scope of the present invention. In addition, any conventional means of changing the current mirror ratio N of the first current mirror 1041 and the second current mirror 1043 can be utilized in the present invention. Since the technique of tuning the current mirror ratio is well known to those skilled in this art, further description is omitted here for brevity.

Figure 11:
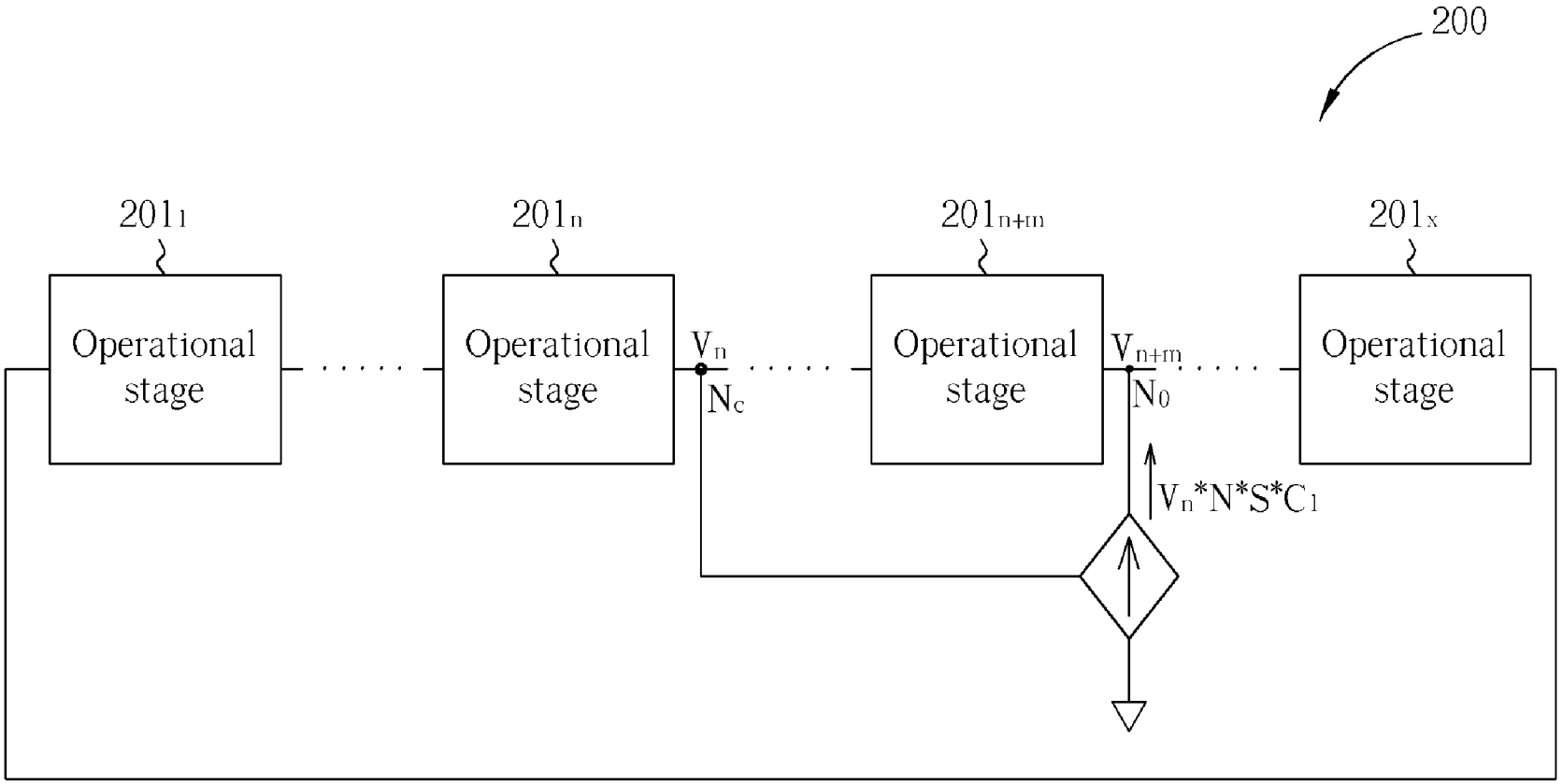
FIG. 11 is a diagram of a feedback-controlled system according to a second embodiment of the present invention.

Please refer to FIG. 11. FIG. 11 is a diagram a feedback-controlled system 200 according an embodiment of the present invention. The feedback-controlled system 200 comprises a plurality of operational stages $\mathbf{201}_1, \ldots, \mathbf{201}_x$ cascaded in a closed loop. In addition, a current generating apparatus 202 is implemented and coupled to the operational stages $\mathbf{201}_{n+m}$. Each of the operational stages $\mathbf{201}_1, \ldots, \mathbf{201}_x$ has a transfer function of $A_1, \ldots, A_x$, respectively. The current generating apparatus 202 has a control terminal $N_c$ coupled to an output of an $n^{th}$ operational stage $\mathbf{201}_n$ and an output terminal $N_o$ coupled to an output of a $(n+m)^{th}$ operational stage $\mathbf{201}_{n+m}$ in the operational stages. The current generating apparatus 202 generates an output current $V_n*N*s*C_1$ to an output of the $(n+m)^{th}$ operational stage $\mathbf{201}_{n+m}$ in the operational stages. Please note that, in this embodiment the current generating apparatus 202 is implemented using the above-mentioned voltage-controlled current source 104 shown in FIG. 8, therefore the detailed description is omitted here for brevity. Through the current generating apparatus 202, a zero can be induced to the feedback-controlled system 200. According to FIG. 11, the voltage $V_{n+m}$ at the output of the $(n+m)^{th}$ operational stage $\mathbf{201}_{n+m}$ is represented using the following equation (5):

$$V_{n+m}=V_n*(A_{n+1}*A_{n+2}\ldots A_{n+m})+V_n*N*s*C_1*R_{IN}. \quad (5)$$

Then, $$V_{n+m}/V_n=(A_{n+1}*A_{n+2}\ldots A_{n+m}+N*s*C_1*R_{IN}). \quad (6)$$

Thus, a zero $\omega_z$ can be obtained from the equation (6), $$\omega_z=(A_{n+1}*A_{n+2}\ldots A_{n+m})/(N*C_1*R_{IN}),$$

wherein $C_1$ is the capacitive device of the voltage-controlled current source 104 of FIG. 8, $R_{IN}$ is the input resistor at the output of the $(n+m)^{th}$ operational stage $\mathbf{201}_{n+m}$, and N is the current mirror ratio of the first current mirror 1041 and the second current mirror 1043. Therefore, by utilizing the current generating apparatus 202 zero $\omega_z$ can be added to the feedback-controlled system 200 and without introducing any pole.

It should be note that a person skilled in this art can readily appreciate that the voltage regulator is a kind of the feedback-controlled system. Referring to FIG. 7 in conjunction with FIG. 11, it is clear that the voltage regulator 100 includes three operational stages connected in a closed loop, where the pass transistor $M_P$ serves as one operational stage, the voltage divider 101 serves as another operation stage, and the error amplifier 102 serves as yet another operational stage.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A current generating apparatus, for generating an output current, comprising:

a first current mirror, for generating a first mirror current according to a first bias current and a current mirror ratio;

a first bias current generator, coupled to the first current mirror, for providing the first bias current according to a first current and a reference current, the first bias current generator comprising:

a first current source, biased by a first bias voltage for providing the first current; and a capacitive device, coupled to the first current source in parallel, for conducting the reference current;

a second current mirror, for generating a second mirror current according to a second bias current and the current mirror ratio;

a second bias current generator, coupled to the second current mirror, the second bias current generator having a second current source biased by the first bias voltage for generating a second current serving as the second bias current;

a third current source, coupled to an output node of the second current mirror, the third current source being biased by a second bias voltage for providing a third current, wherein the second mirror current is equal to the third current;

a feedback circuit, coupled to the output node of the second current mirror and the third current source, for tuning the second bias voltage according to a voltage level at the output node of the second current mirror and a target voltage level; and a fourth current source, coupled to an output node of the first current mirror, the fourth current source being biased by the second bias voltage for providing a fourth current, wherein the output current is outputted at the output node of the first current mirror.

2. The current generating apparatus of claim 1, wherein the first current source comprises a first transistor having a control node coupled to the first bias voltage, a first node, and a second node coupled to a first reference voltage level; the second current source comprises a second transistor having a control node coupled to the first bias voltage, a first node, and a second node coupled to the first reference voltage level, and the first bias current generator further comprises:

a third transistor, having a first node coupled to the first current mirror, a second node coupled to the first node of the first transistor, and a control node; and a first error amplifier, having a first input node coupled to a second reference voltage level, a second input node coupled to the second node of the third transistor, and an output node coupled to the control node of the third transistor; and the second bias current generator further comprises:

a fourth transistor, having a first node coupled to the second current mirror, a second node coupled to the first node of the second transistor, and a control node; and a second error amplifier, having a first input node coupled to the second reference voltage level, a second input node coupled to the second node of the fourth transistor, and an output node coupled to the control node of the fourth transistor.

3. The current generating apparatus of claim 1, wherein the third current source comprises a fifth transistor having a control node for receiving the second bias voltage, a first node coupled to the output node of the second current mirror, and a second node coupled to the first reference voltage level; the fourth current source comprises a sixth transistor having a control node coupled to the control node of the fifth transistor, a first node coupled to the output node of the first current mirror, and a second node coupled to the first reference voltage level, and the feedback circuit comprises:

a third error amplifier, having a first input node coupled to the first node of the fifth transistor, a second input node coupled to the target voltage level, and an output node coupled to the control node of the fifth transistor.

4. A feedback-controlled system, comprising:

a plurality of operational stages cascaded in a closed loop; and a current generating apparatus, for generating an output current to an output of a first operational stage in the operational stages, the current generating apparatus comprising:

a first current mirror, for generating a first mirror current according to a first bias current and a current mirror ratio;

a first bias current generator, coupled to the first current mirror, for receiving an output of a second operational stage in the operational stages and providing the first bias current according to a first current and a reference current, the first bias current generator comprising:

a first current source, for providing the first current according to a first bias voltage and the output of the second operational stage; and a capacitive device, coupled to the first current source in parallel, for conducting the reference current;

a second current mirror, for generating a second mirror current according to a second bias current and the current mirror ratio;

a second bias current generator, coupled to the second current mirror, the second bias current generator having a second current source for generating a second current serving as the second bias current according to the first bias voltage and the output of the second operational stage;

a third current source, coupled to an output node of the second current mirror, the third current source being biased by a second bias voltage for providing a third current, wherein the second mirror current is equal to the third mirror current;

a feedback circuit, coupled to the output node of the second current mirror and the third current source, for tuning the second bias voltage according to a voltage level at the output node of the second current mirror and a target voltage level; and a fourth current source, coupled to an output node of the first current mirror, the fourth current source being biased by the second bias voltage for providing a fourth current, wherein the output current is outputted from the output node of the first current mirror.

5. The feedback-controlled system of claim 4, wherein the first current source comprises a first transistor having a control node coupled to the first bias voltage, a first node, and a second node coupled to a first reference voltage level; the second current source comprises a second transistor having a control node coupled to the first bias voltage, a first node, and a second node coupled to the first reference voltage level, and the first bias current generator further comprises:

a third transistor, having a first node coupled to the first current mirror, a second node coupled to the first node of the first transistor, and a control node; and a first error amplifier, having a first input node coupled to a second reference voltage level, a second input node coupled to the second node of the third transistor, and an output node coupled to the control node of the third transistor; and the second bias current generator further comprises:

a fourth transistor, having a first node coupled to the second current mirror, a second node coupled to the first node of the second transistor, and a control node; and a second error amplifier, having a first input node coupled to the second reference voltage level, a second input node coupled to the second node of the fourth transistor, and an output node coupled to the control node of the fourth transistor.

6. The feedback-controlled system of claim 4, wherein the third current source comprises a fifth transistor having a control node for receiving the second bias voltage, a first node coupled to the output node of the second current mirror, and a second node coupled to the first reference voltage level; the fourth current source comprises a sixth transistor having a control node coupled to the control node of the fifth transistor, a first node coupled to the output node of the first current mirror, and a second node coupled to the first reference voltage level, and the feedback circuit comprises:

a third error amplifier, having a first input node coupled to the first node of the fifth transistor, a second node coupled to the target voltage level, and an output node coupled to the control node of the fifth transistor.

7. The feedback-controlled system of claim 4, wherein the current generating apparatus further comprises:

a loading sensing circuit, coupled to the first current mirror and the second current mirror, for sensing loading variation of the feedback-controlled system to adjust the current mirror ratio of the first current mirror and the second current mirror.

8. The feedback-controlled system of claim 7, wherein the loading sensing circuit decreases the current mirror ratio of the first current mirror and the second current mirror when detecting that the loading of the feedback-controlled system increases, and the loading sensing circuit increases the current mirror ratio of the first current mirror and the second current mirror when detecting that the loading of the feedback-controlled system decreases.

9. The feedback-controlled system of claim 4, being a voltage regulator, wherein the second operational stage comprises a pass transistor, the first operational stage is a voltage divider for providing a feedback voltage level according to an output voltage level passed by the pass transistor; and the operational stages also include a third operational stage comprising a fourth error amplifier having a first input node coupled to the voltage divider for receiving the feedback voltage level, a second input node coupled to the target voltage level, and an output node coupled to a control node of the pass transistor.

10. The feedback-controlled system of claim 9, wherein the first current source comprises a first transistor having a control node coupled to the first bias voltage, a first node, and a second node coupled to a first reference voltage level; the second current source comprises a second transistor having a control node coupled to the first bias voltage, a first node, and a second node coupled to the first reference voltage level, and the first bias current generator further comprises:

a third transistor, having a first node coupled to the first current mirror, a second node coupled to the first node of the first transistor, and a control node; and a first error amplifier, having a first input node coupled to a second reference voltage level, a second input node coupled to the second node of the third transistor, and an output node coupled to the control node of the third transistor; and the second bias current generator further comprises:

a fourth transistor, having a first node coupled to the second current mirror, a second node coupled to the first node of the second transistor, and a control node; and a second error amplifier, having a first input node coupled to the second reference voltage level, a second input node coupled to the second node of the fourth transistor, and an output node coupled to the control node of the fourth transistor.

11. The feedback-controlled system of claim 9, wherein the third current source comprises a fifth transistor having a control node for receiving the second bias voltage, a first node coupled to the output node of the second current mirror, and a second node coupled to the first reference voltage level; the fourth current source comprises a sixth transistor having a control node coupled to the control node of the fifth transistor, a first node coupled to the output node of the first current mirror, and a second node coupled to the first reference voltage level, and the feedback circuit comprises:

a third error amplifier, having a first input node coupled to the first node of the fifth transistor, a second node coupled to the target voltage level, and an output node coupled to the control node of the fifth transistor.

12. The feedback-controlled system of claim 9, wherein the current generating apparatus further comprises:

a loading sensing circuit, coupled to the first current mirror and the second current mirror, for sensing loading variation of the voltage regulator to adjust the current mirror ratio of the first current mirror and the second current mirror.

13. The feedback-controlled system of claim 12, wherein the loading sensing circuit decreases the current mirror ratio of the first current mirror and the second current mirror when detecting that the loading of the voltage regulator increases, and the loading sensing circuit increases the current mirror ratio of the first current mirror and the second current mirror when detecting that the loading of the voltage regulator decreases.

* * * * *